US012654971B2

(12) United States Patent
Ueno

(10) Patent No.: US 12,654,971 B2
(45) Date of Patent: Jun. 16, 2026

(54) SHEET ALIGNMENT DEVICE WITH MECHANISM THAT MOVES ROLLER SUPPORT DEVICE UP AND DOWNWARD

(71) Applicant: KYOCERA Document Solutions Inc., Osaka (JP)

(72) Inventor: Daijiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 27 days.

(21) Appl. No.: 19/042,448

(22) Filed: Jan. 31, 2025

(65) Prior Publication Data

US 2025/0250135 A1 Aug. 7, 2025

(30) Foreign Application Priority Data

Feb. 5, 2024 (JP) ..... 2024-015900

(51) Int. Cl.
*B65H 9/14* (2006.01)
*B65H 9/10* (2006.01)

(52) U.S. Cl.
CPC ..... *B65H 9/106* (2013.01); *B65H 9/14* (2013.01); *B65H 2404/1621* (2013.01)

(58) Field of Classification Search
CPC . B65H 9/00; B65H 9/16; B65H 9/106; B65H 9/14; B65H 9/166; B65H 2404/1621
See application file for complete search history.

(56) References Cited

U.S. PATENT DOCUMENTS

2005/0129440 A1 6/2005 Nagata et al.
2007/0284803 A1* 12/2007 Oomori ..... B65H 3/0669 271/10.01
2019/0241384 A1* 8/2019 Terao ..... B65H 7/10

FOREIGN PATENT DOCUMENTS

JP 2000219357 A 8/2000
JP 2005255383 A 9/2005
WO WO-2014063598 A1 * 5/2014 ..... B65H 9/166

* cited by examiner

*Primary Examiner* — Thomas A Morrison
(74) *Attorney, Agent, or Firm* — IP Business Solutions, LLC.

(57) ABSTRACT

A sheet alignment device includes a roller that moves a sheet on a sheet transport route so that a side edge of the sheet abuts against an alignment member, a first one-way clutch that transmits a first rotative driving force for making a roller support device pivot upward with respect to the shaft of the roller support device, when a motor rotates in a first direction, a first torque limiter that disconnects the transmission of the first rotative driving force, when a rotation control device limits the rotation of the shaft, a second one-way clutch that rotates with a second rotative driving force, and making the roller support device pivot downward, when the motor is stopped, and a second torque limiter that stops the rotation of the shaft, by being subjected to a rotational torque of the second one-way clutch.

5 Claims, 11 Drawing Sheets

SHEET ALIGNMENT DEVICE WITH MECHANISM THAT MOVES ROLLER SUPPORT DEVICE UP AND DOWNWARD

INCORPORATION BY REFERENCE

This application claims priority to Japanese Patent Application No. 2024-015900 filed on Feb. 5, 2024, the entire contents of which are incorporated by reference herein.

BACKGROUND

The present disclosure relates to a sheet alignment device that aligns the side edge of a sheet being transported along a sheet transport route.

In many of existing image forming systems, a sheet is supplied by a sheet transport device to an image forming apparatus, so that the image forming apparatus forms an image on the sheet. When paper jam occurs in such an image forming system, the jammed sheet has to be removed.

For example, a transport route opening mechanism is known, configured such that the transport route cover can be opened so as to expose a part of the transport route, when paper jam occurs on the transport route, and the pressure of the transport roller can be loosened to facilitate the jammed sheet to be removed.

In addition, an image forming apparatus is known including transport rollers and free rollers, for transporting the sheet from the sheet storage section to the image forming device, and a moving mechanism that moves the transport roller and the free roller away from each other, in linkage with the removal motion of the, and brings the transport roller and the free roller into pressure-contact with each other, in linkage with the setting motion of the sheet storage section, thereby facilitating the jammed sheet to be removed.

SUMMARY

The disclosure proposes further improvement of the foregoing technique.

In an aspect, the disclosure provides a sheet alignment device including a sheet transport route, an alignment member, a roller, a roller support device, a motor, a first one-way clutch, a rotation control device, a first torque limiter, a second one-way clutch, and a second torque limiter. On the sheet transport route, a sheet is transported. The alignment member is provided along a side edge of the sheet located on the sheet transport route. The roller rotates by being contacted by the sheet being transported along the sheet transport route, and makes the side edge of the sheet abut against the alignment member, by moving the sheet in a direction orthogonal to a sheet transport direction. The roller support device supports the roller. The roller support device includes a shaft spaced from the roller, and is configured to make the roller contact the sheet or move away therefrom, by being supported so as to reciprocatively pivot about the shaft in an up-down direction. The motor provides a rotative driving force. The first one-way clutch transmits a first rotative driving force for making the roller support device pivot upward with respect to the shaft of the roller support device, when the motor rotates in a predetermined first direction. The rotation control device limits rotation of the shaft, when the roller support device is made to pivot upward. The first torque limiter disconnects the first rotative driving force from the first one-way clutch, when the rotation control device limits the rotation of the shaft. The second one-way clutch rotates with a second rotative driving force, generated by a self-weight of the roller support device when the motor is stopped, and making the roller support device pivot downward. The second torque limiter stops the rotation of the shaft, by being subjected to a rotational torque of the second one-way clutch.

DETAILED DESCRIPTION

Figure 1:
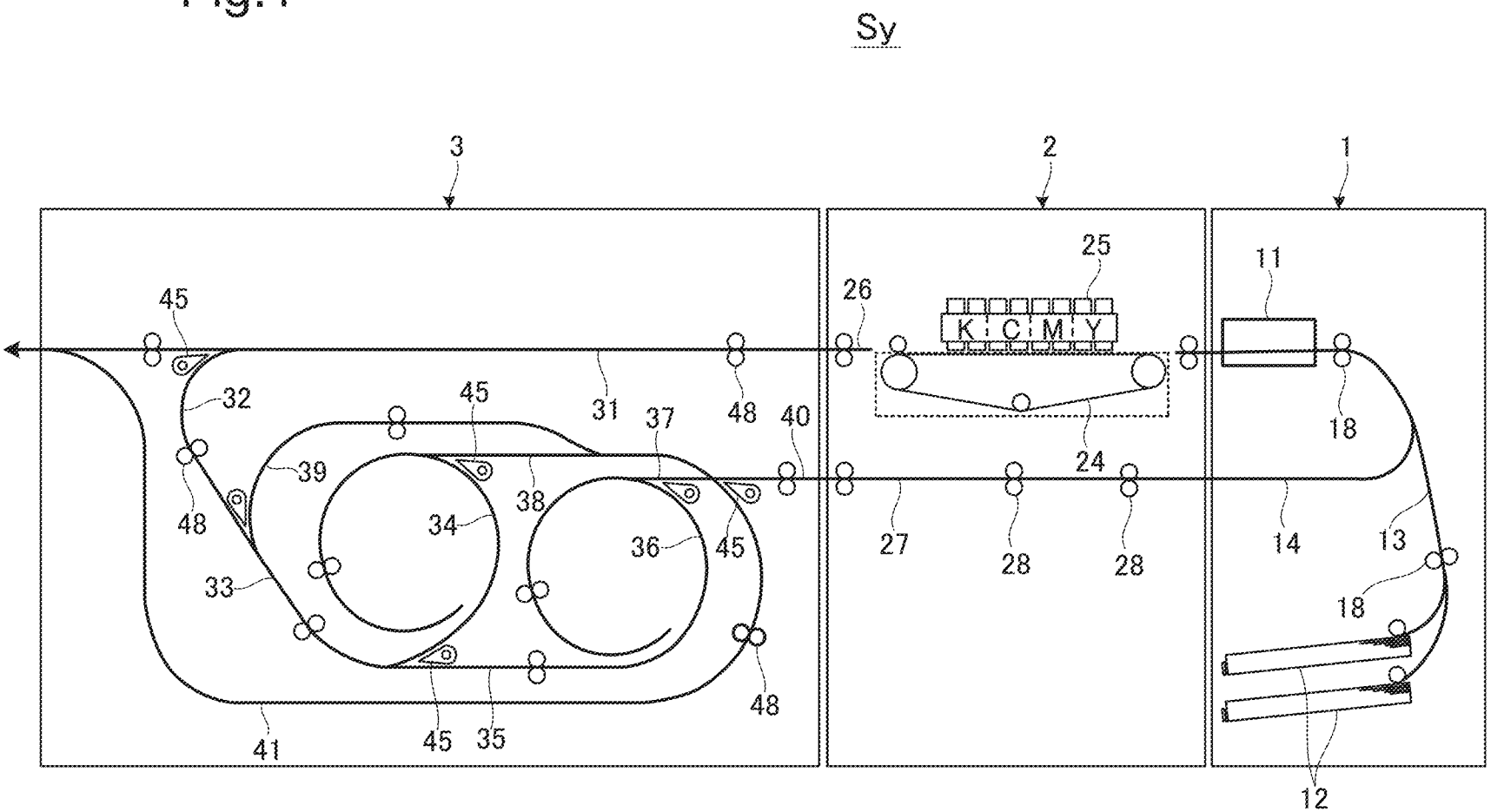
FIG. 1 is a schematic side view of an image forming system, incorporated with a sheet alignment device according to an embodiment of the disclosure.

Hereafter, an embodiment of the disclosure will be described with reference to the drawings. FIG. 1 is a schematic side view of an image forming system, incorporated with a sheet alignment device according to the embodiment. The terms "up-down direction", "left-right direction", "clockwise", and "counterclockwise" used in the following description are based on the direction of each of the drawings.

As shown in FIG. 1, the image forming system Sy includes a sheet feeding device 1, an image forming apparatus 2, and a sheet transport device 3. The sheet feeding device 1 supplies a sheet to the image forming apparatus 2. The image forming apparatus 2 receives the sheet from the sheet feeding device 1, and forms an image on the sheet. The sheet transport device 3 receives the sheet from the image forming apparatus 2 and transports the same, and either delivers the sheet to outside, or returns the sheet to the sheet feeding device 1, through the image forming apparatus 2.

The sheet feeding device 1 includes a sheet alignment device 11, sheet cassettes 12 in each of which a plurality of sheets are accommodated, a forward transport route 13, a reversing transport route 14, and a plurality of transport rollers 18, for transporting the sheet along the forward transport route 13 or the reversing transport route 14. The forward transport route 13 is for transporting the sheet, drawn out from one of the sheet cassettes 12, toward the sheet alignment device 11.

The reversing transport route 14 is for receiving the sheet returned to the sheet feeding device 1 through the image forming apparatus 2, reverses the front and back faces of the sheet, and again transports the sheet to the sheet alignment device 11. The sheet alignment device 11 aligns the side edge of the sheet, upon receipt thereof from the forward transport route 13 or the reversing transport route 14, so as to adjust the position of the sheet in the width direction, and transports the sheet to the image forming apparatus 2.

The image forming apparatus 2 includes a conveying belt 24 that conveys the sheet received from the sheet feeding device 1, an image forming device 25 that forms an image on the sheet, a transport route 26 for transporting the sheet to the sheet transport device 3, a transport route 27 for receiving the sheet returned from the sheet transport device 3 and transporting the sheet to the sheet feeding device 1, and a plurality of transport rollers 28 for transporting the sheet along the transport routes 26 and 27.

The image forming device 25 forms an image on the sheet, by an ink jet printing method. The image forming device 25 includes ink cartridges, ink tanks, pumps, heads, nozzles, and electrodes. In each of the ink cartridges and ink tanks, for example, ink of one of yellow (Y), magenta (M), cyan (C), and black (Bk) colors is stored.

The pump serves to supply the ink from the ink tank to the head. The head includes a multitude of nozzles for forming pixels. The ink of the color corresponding to the image data is supplied from the ink tank to the head. The ink is ejected from the nozzles toward the sheet. The electrode includes, for example, a charging electrode and a deflection electrode. The charging electrode electrically charges the ink ejected from the nozzle. The deflection electrode controls the flying direction of the charged ink.

The sheet transport device 3 includes a main transport route 31, a plurality of transport routes 32 to 39, a relay transport route 40, a sub transport route 41, branch nails 45 provided at the branch point of the respective transport routes 31 to 41, and a plurality of transport rollers 48 for transporting the sheet along the transport routes 31 to 41.

In the sheet transport device 3, the branch nails 45 are selectively switched, to transport the sheet through at least one of the transport routes 31 to 41. The selection and combination of the transport routes 31 to 41, through which the sheet is to be transported, are determined depending on which of simplex printing or duplex printing is to be executed, and on the size (length) of the sheet.

In the sheet transport device 3, for example when the sheet is to be subjected to the simplex printing (front face printing), the sheet is transported from the transport route 26 of the image forming apparatus 2 to the main transport route 31, in a face-up posture (front face oriented upward). Then the branch nails 45 are switched as necessary, so that the sheet is transported or switched back, through some of the transport routes 32 to 39, conducted to the sub transport route 41, and transported from the sub transport route 41 along the main transport route 31 in a face-down posture (front face oriented downward), to be delivered to outside.

The selection of the transport routes 32 to 39 is performed as necessary, depending on the size of the sheet. For example, in the case of a regular-size sheet, the sheet is transported through the transport routes 32, 33, and 34. The transport of the sheet is stopped when the sheet reaches the drum-shaped section of the transport route 34, and then the sheet is switched back, so as to be led to the sub transport route 41 or the relay transport route 40 from the drum-shaped transport route 34, through the transport route 38.

In the case of a long-size sheet, the sheet is transported through the transport routes 32, 33, 35, and 36. The transport of the sheet is stopped when the sheet enters the transport routes 33 and 35, and the drum-shaped section of the transport route 36, and the sheet is switched back so as to be led to the sub transport route 41 or the relay transport route 40, from the transport route 33 through the transport route 39.

When the sheet is to be subjected to the duplex printing, the sheet that has undergone the simplex (front face) printing is transported from the transport route 26 of the image forming apparatus 2 to the main transport route 31, in the face-up posture (front face oriented upward). Then the branch nails are switched as necessary, so that the sheet is transported or switched back, through some of the transport routes 32 to 39, and conducted to the relay transport route 40. Then the sheet is transported, in the face-up posture, from the relay transport route 40 to the reversing transport route 14 of the sheet feeding device 1, through the transport route 27 of the image forming apparatus 2.

In the sheet feeding device 1, when the sheet is transported from the relay transport route 40 of the sheet transport device 3 to the reversing transport route 14, through the transport route 27 of the image forming apparatus 2, the front and back faces of the sheet are reversed by passing through the reversing transport route 14, and the sheet is transported, in the face-down posture (front face oriented downward), to the image forming apparatus 2 through the sheet alignment device 11.

In the image forming apparatus 2, the image forming device 25 performs the duplex printing, when the sheet is received in the face-down posture (front face oriented downward). Thereafter, the sheet is transported from the transport route 26 of the image forming apparatus 2, to the main transport route 31 of the sheet transport device 3, in the face-down posture (front face oriented downward).

In the sheet transport device 3, when the sheet that has undergone the duplex printing is received by the main transport route 31, in the face-down posture (front face oriented downward), from the transport route 26 of the image forming apparatus 2, the sheet is transported along the main transport route 31 in the face-down posture (front face oriented downward), and delivered to outside.

Figure 2:
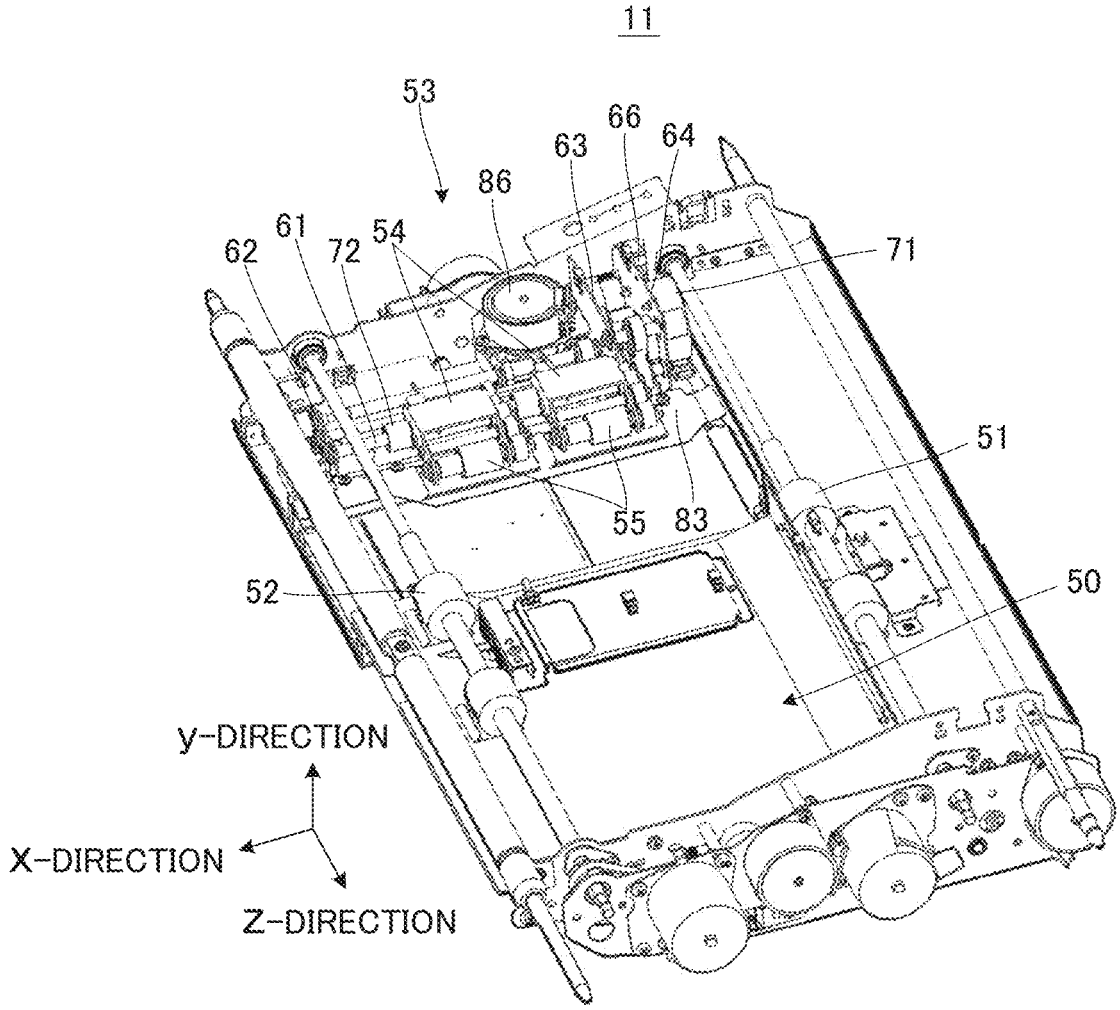
FIG. 2 is a perspective view of the sheet alignment device, seen from an obliquely upper position.

Hereunder, the sheet alignment device 11 will be described in detail. FIG. 2 is a perspective view of the sheet alignment device 11, seen from an obliquely upper position. In FIG. 2 to FIG. 9, an x-direction indicates the transport direction of the sheet, a y-direction indicates the height direction, and a z-direction indicates the width direction of the sheet.

As shown in FIG. 2, the sheet alignment device 11 includes a sheet transport route 50, two transport rollers 51 and 52, and a sheet alignment mechanism 53. The transport rollers 51 and 52 each serve to transport the sheet, delivered from the forward transport route 13 or the reversing transport route 14 of the sheet feeding device 1, in the sheet transport direction x along the sheet transport route 50, and deliver the sheet to the transport route 26 of the image forming apparatus 2. The sheet alignment mechanism 53 is located along one of the side edges of the sheet transported by the transport rollers 51 and 52, to align the side edge of the sheet, thereby adjusting the position of the sheet in the width direction z.

Figure 3:
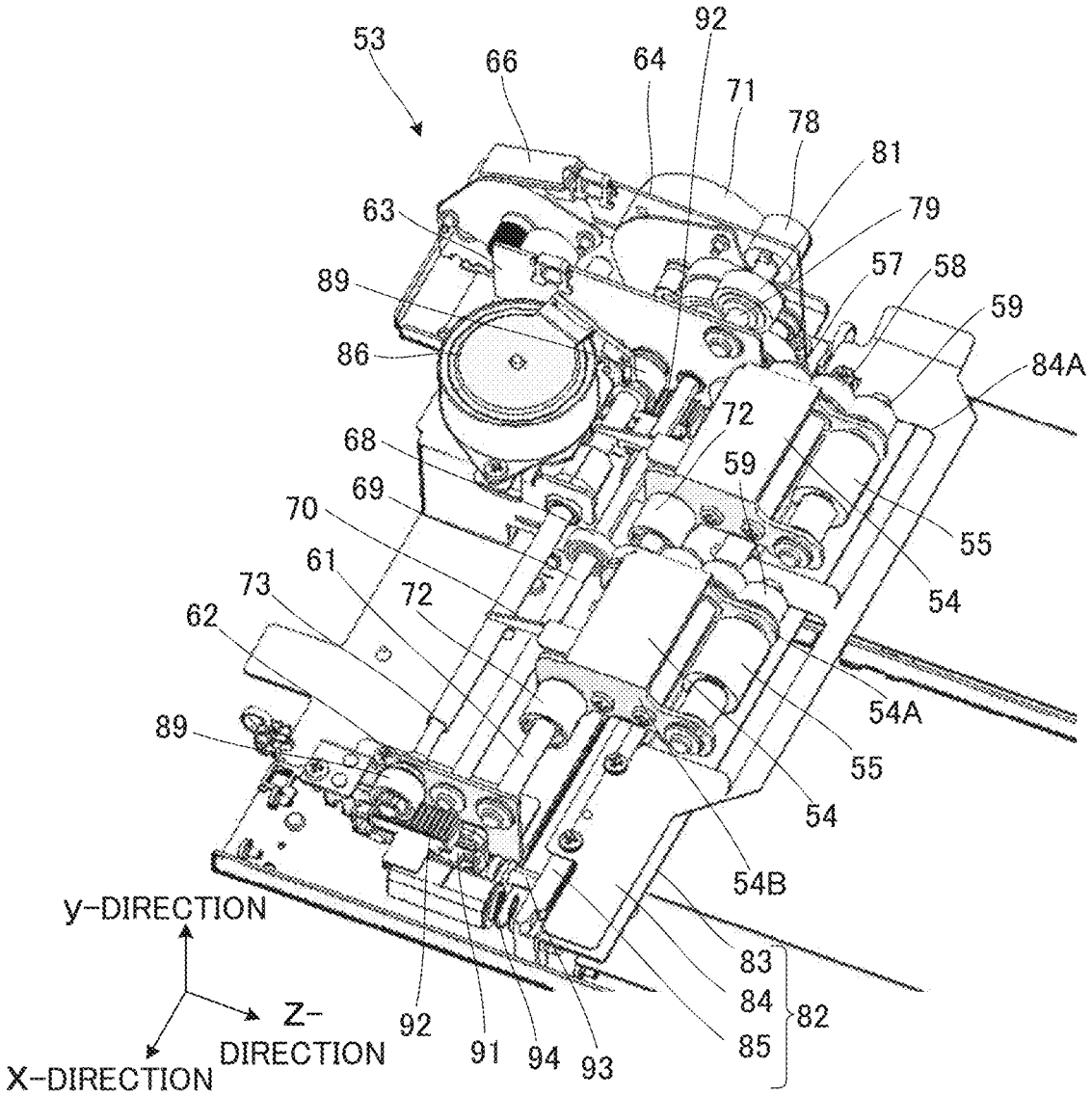
FIG. 3 is a perspective view of a sheet alignment mechanism of the sheet alignment device, seen from a downstream side in a sheet transport direction.
Figure 4:
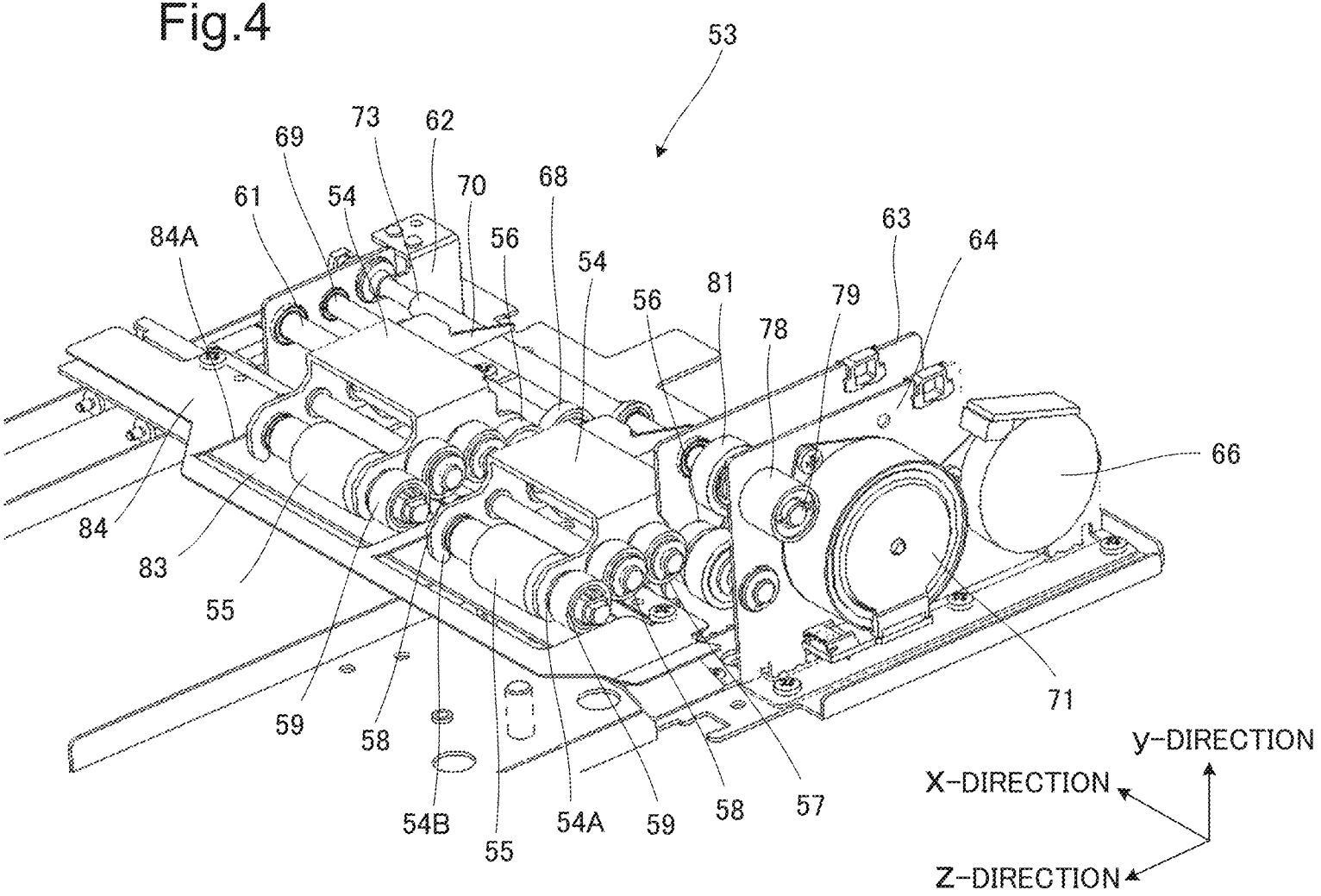
FIG. 4 is a perspective view of the sheet alignment mechanism, seen from an upstream side in the sheet transport direction.
Figure 5:
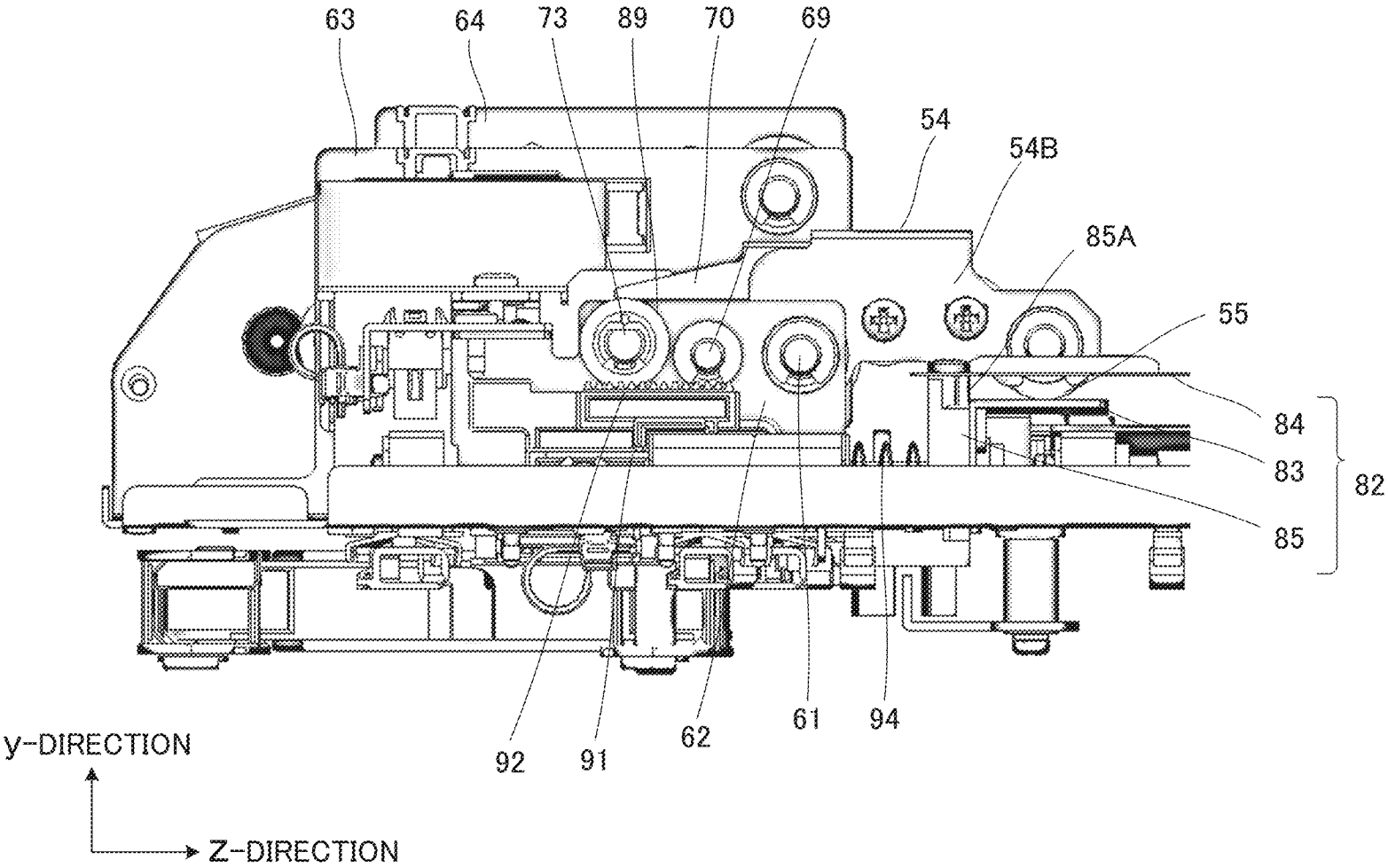
FIG. 5 is a side view of the sheet alignment mechanism, seen from the downstream side in the sheet transport direction.

FIG. 3 is a perspective view of the sheet alignment mechanism 53, seen from a downstream side in the sheet transport direction x. FIG. 4 is a perspective view of the sheet alignment mechanism 53, seen from an upstream side in the sheet transport direction x. FIG. 5 is a side view of the sheet alignment mechanism 53, seen from the downstream side in the sheet transport direction x.

As shown in FIG. 2 to FIG. 5, the sheet alignment mechanism 53 includes three support plates 62, 63, and 64, erected parallel to each other with a spacing therebetween in the sheet transport direction x. In addition, a main shaft 61 is provided so as to connect the outer support plates 62 and 64, and supported thereby parallel to the sheet trans port direction x.

The sheet alignment mechanism 53 includes two roller support frames 54, located side by side along the sheet transport direction x. The roller support frames 54 each include a pair of side plates 54A and 54B, opposed to each other in the sheet transport direction x. The side plates 54A and 54B of each of the roller support frames 54 rotatably support the shaft of a pressing roller 55 at the respective distal end portions, such that the pressing roller 55 extends orthogonal to the sheet width direction z.

On the outer side of the side plate 54A of each of the roller support frames 54, four gears 56 to 59, meshed with each other, are provided. In both of the roller support frames 54, the gear 59 on the side of the distal end of the side plate 54A is connected to the shaft of the pressing roller 55, and the shaft of the pressing roller 55 is passed through holes of the respective side plates 54A and 54B, thus to be rotatably supported. The gear 59 and the pressing roller 55 are configured to rotate interlocked with each other.

In both of the roller support frames 54, the gear 56 on the side of the rear end of the side plate 54A is supported by a main shaft 61, passed through holes of the respective side plates 54A and 54B. The main shaft 61 is rotatably inserted to the rotation center of the gear 56, so that the gear 56 can freely rotate around the main shaft 61.

In both of the roller support frames 54, two inner gears 57 and 58 on the side plate 54A are each supported by a shaft, rotatably passed through holes of the respective side plates 54A and 54B.

On the outermost support plate 64 on one side of the sheet alignment mechanism 53, a motor 66, serving as the power source for supplying rotative driving force to rotate the pressing rollers 55 of the respective roller support frames 54, is provided. The rotative driving force of the motor 66 is transmitted to the gear 56 of the roller support frame 54, via a gear unit 67 (see FIG. 6A and FIG. 6B) provided on the support plate 63.

In both of the roller support frames 54, when the gear 56 rotates, the rotation of the gear 56 is transmitted to the gear 59 via the gears 57 and 58, so that the gear 59 and the pressing roller 55 are made to rotate.

Figure 6A:
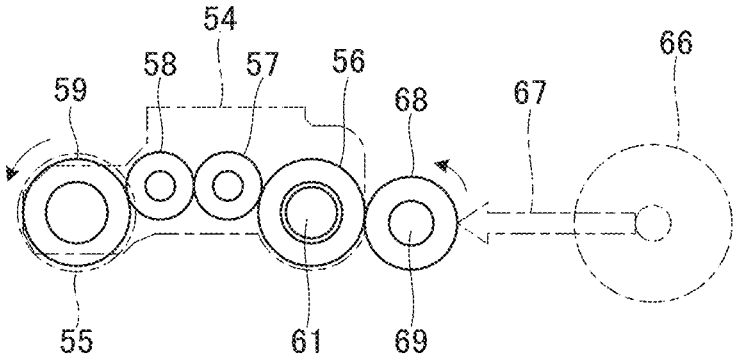
FIG. 6A is a schematic side view of a motor, a gear unit, and gears, for making a pressing roller in the sheet alignment mechanism pivot.

FIG. 6A schematically illustrates the motor 66, the gear unit 67, and the gears 56 to 59. Referring to FIG. 6A, the gear unit 67 receives and transmits the rotative driving force of the motor 66, to thereby rotate two output gears 68 of the gear unit 67.

As shown in FIG. 3, a shaft 69 of the two output gears 68 extends between the support plates 62 and 63 and is supported thereby. One of the output gears 68 is meshed with the gear 56 of one of the roller support frame 54, between the support plates 62 and 63, and the other output gear 68 is meshed with the gear 56 of the other roller support frame 54, at a position close to the center of the shaft 69.

As shown in FIG. 6A, when the output gear 68 of the gear unit 67 rotates, the gear 56 of the roller support frame 54 rotates around the main shaft 61. In both of the roller support frames 54, the rotation of the gear 56 is transmitted to the gear 59 via the gears 57 and 58, so that the gear 59 and the pressing roller 55 are made to rotate. The rotation direction of the output shaft of the motor 66 is set so as to make the gear 59 and the pressing roller 55 of each of the roller support frames 54 rotate counterclockwise.

Referring again to FIG. 3, in both of the roller support frames 54, the main shaft 61 is passed through a hole of the side plate 54A, thus to be rotatably supported thereby, and connected to a first torque limiter (upper-limit torque limiter) 72 fixed to the side plate 54B.

The first torque limiter 72 transmits a first rotational torque T1 of the main shaft 61 to the side plate 54B of the roller support frame 54, when the first rotational torque T1 of the main shaft 61 is lower than a first threshold S1, and disconnects the transmission of the first rotational torque T1 of the main shaft 61, when the first rotational torque T1 of the main shaft 61 is equal to or higher than the first threshold S1.

Two stoppers 70, exemplifying the rotation control device in the disclosure, are fixed to each of the roller support frames 54, so as to extend to a position above a shaft 73 extending parallel to the sheet transport direction x.

As will be subsequently described, when the main shaft 61 rotates, and the first rotational torque T1 of the main shaft 61 is transmitted to the side plate 54B of the roller support frame 54, via the first torque limiter 72, the roller support frame 54 is made to pivot upward, and the pressing roller 55 moves upward. Here, the expression "roller support frame 54 is made to pivot upward" indicates that the roller support frame 54 is made to pivot upward, with respect to the shaft 73.

When the roller support frame 54 moves further upward, the tip portion of the stopper 70 of the roller support frame 54 abuts against the shaft 73. At this point, the first rotational torque T1, transmitted from the main shaft 61 to the side plate 54B of the roller support frame 54, becomes equal to or higher than the first threshold S1, and therefore the first torque limiter 72 disconnects the first rotational torque T1 transmitted to the side plate 54B of the roller support frame 54, thereby stopping the movement of the roller support frame 54.

Thus, the upward pivotal motion of the roller support frame 54, in other words the position thereby reached, is limited by the stopper 70, and the pressing roller 55 is stopped at the upper-limit position.

Figure 6B:
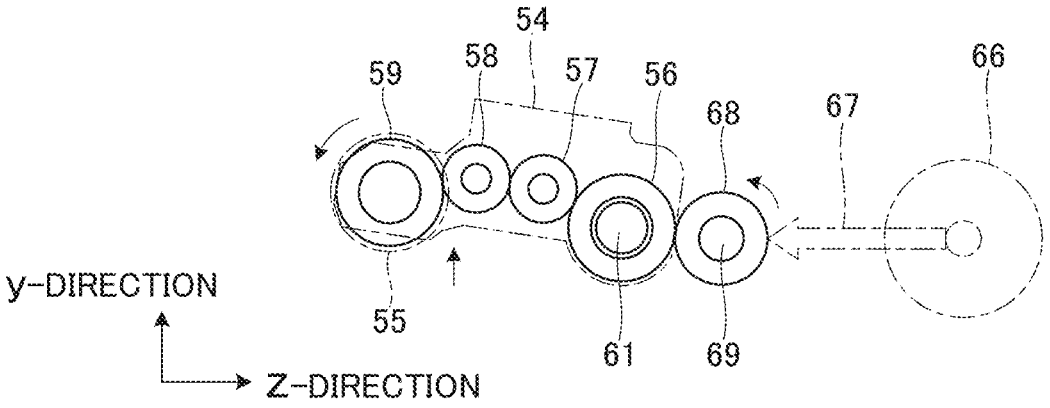
FIG. 6B is a schematic side view showing the pressing roller elevated.

At this point, the positional relation between the two output gears 68 of the gear unit 67 and the main shaft 61 is maintained as shown in FIG. 6B. Therefore, the gear 56 of the roller support frame 54 is made to rotate around the main shaft 61, by the rotation of the output gear 68 of the gear unit 67, and the gear 59 and the pressing roller 55 are also made to rotate.

On the outermost support plate 64 on one side of the sheet alignment mechanism 53, a motor 71, serving as the power source for making the main shaft 61 rotate, is provided. The rotative driving force of the motor 71 is transmitted to the main shaft 61, via a gear unit 74 (see FIG. 7) provided on the support plate 63.

Figure 7:
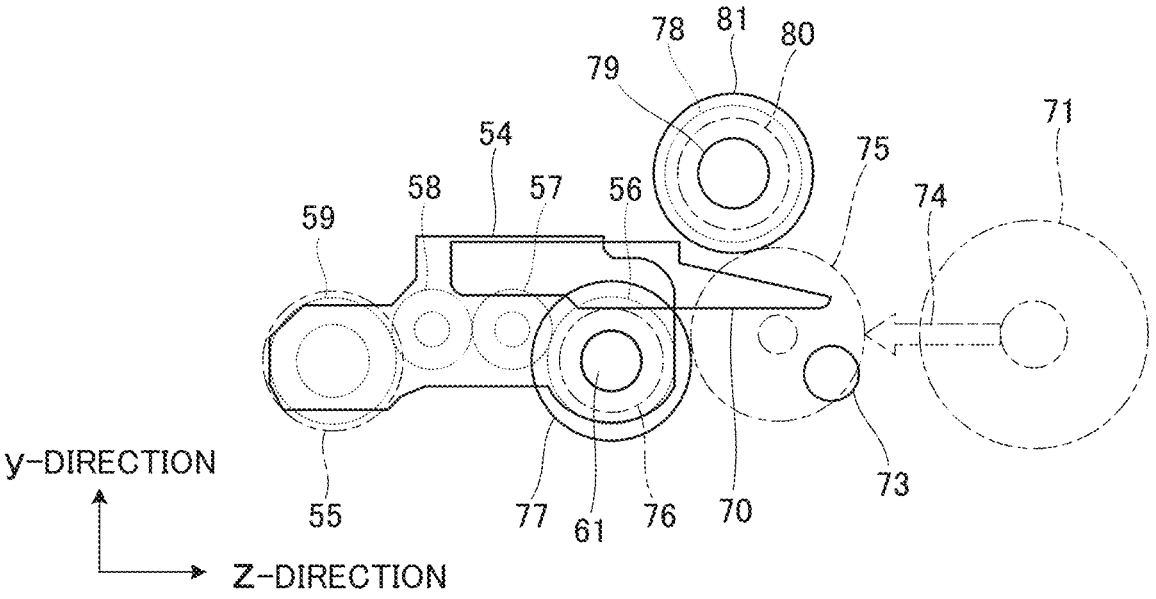
FIG. 7 is a schematic side view of a motor, a gear unit, and a first one-way clutch, for moving the pressing roller up and downward.

FIG. 7 schematically illustrates the motor 71, the gear unit 74 that transmits the rotative driving force of the motor 71, and the first one-way clutch 76.

Referring to FIG. 7, the gear unit 74 receives and transmits the rotative driving force of the motor 71, so as to make an output gear 75 of the gear unit 74. To the main shaft 61, the first one-way clutch 76 is connected, and also an elevation gear 77 is connected via the first one-way clutch 76. The elevation gear 77 is meshed with the output gear 75 of the gear unit 74.

Figure 8A:
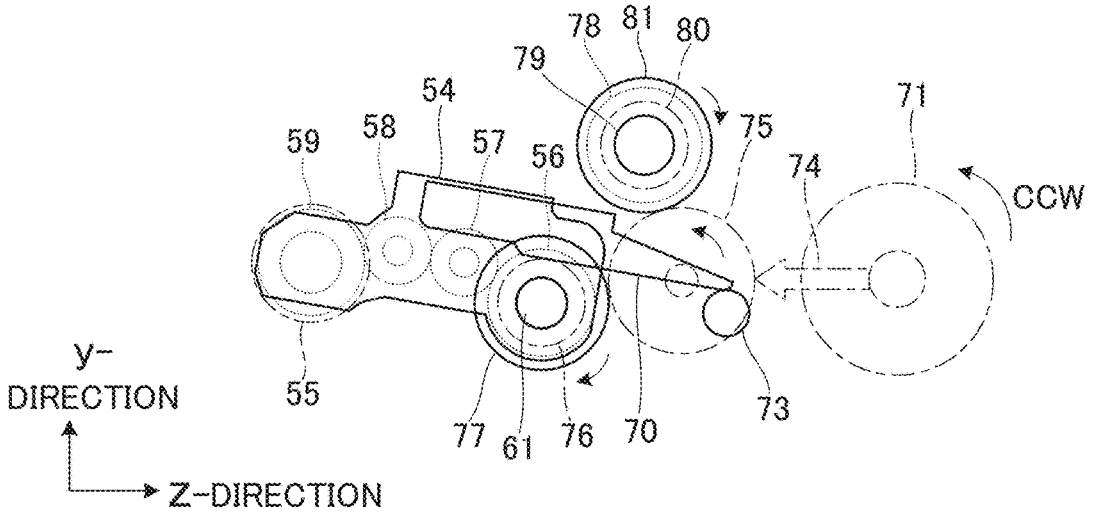
FIG. 8A is a schematic side view showing the movement of the motor, the gear unit, and the first one-way clutch, made when the motor rotates in one direction to elevate the pressing roller.

For example, when the motor 71 rotates counterclockwise CCW as shown in FIG. 8A, the output gear 75 of the gear unit 74 rotates counterclockwise, and the elevation gear 77 rotates clockwise. In this case, the first one-way clutch 76 transmits the clockwise rotation of the elevation gear 77 to the main shaft 61, thereby making the main shaft 61 rotate clockwise.

Figure 8B:
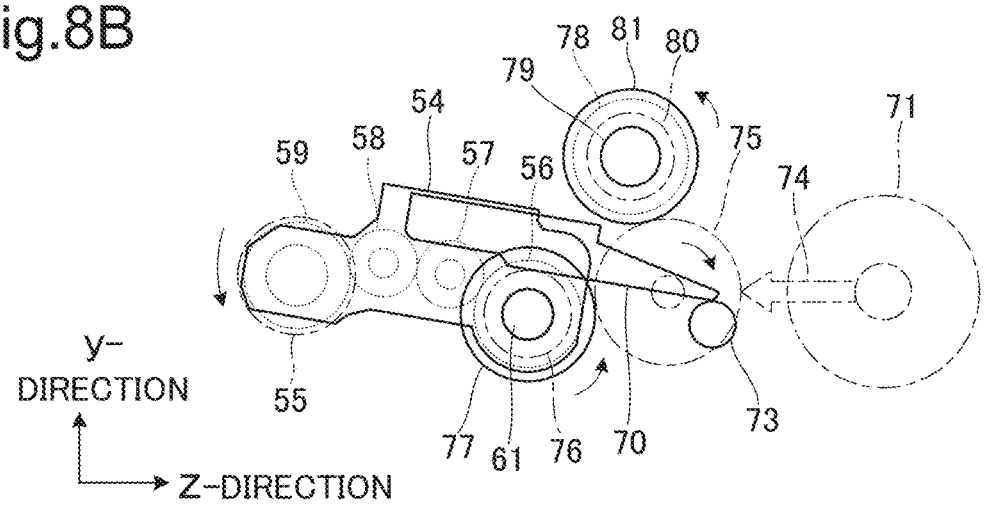
FIG. 8B is a schematic side view showing the movement of the motor, the gear unit, and the first one-way clutch, made when the motor is stopped.
Figure 8C:
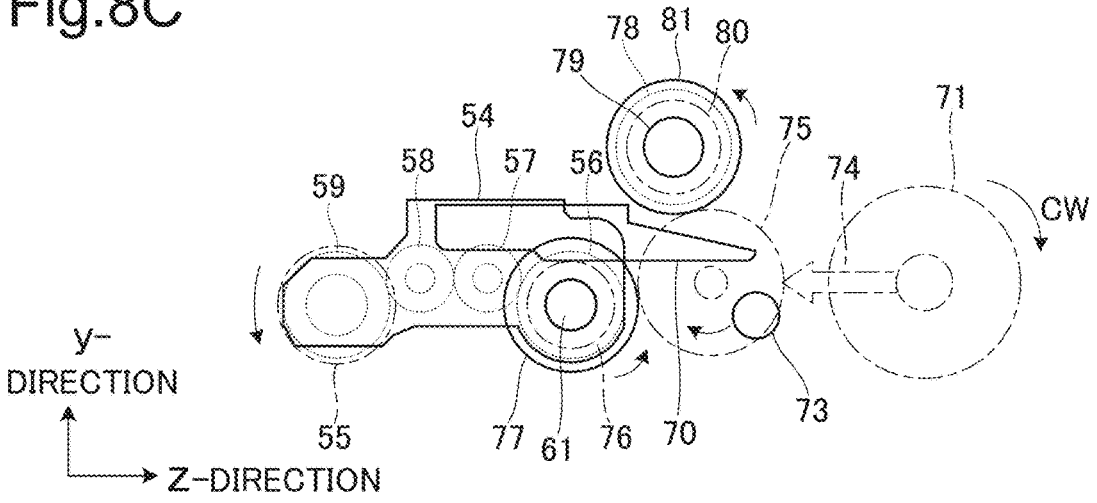
FIG. 8C is a schematic side view showing the movement of the motor, the gear unit, and the first one-way clutch, made when the motor rotates in the opposite direction.

When the motor 71 rotates clockwise CW as shown in FIG. 8C, the output gear 75 of the gear unit 74 rotates clockwise, and the elevation gear 77 rotates counterclockwise. In this case, the first one-way clutch 76 runs idle, and the counterclockwise rotation of the elevation gear 77 is not transmitted to the main shaft 61.

Accordingly, when the motor 71 rotates counterclockwise CCW, the output gear 75 of the gear unit 74 rotates counterclockwise, the elevation gear 77 rotates clockwise, and the main shaft 61 rotates clockwise, the first rotational torque T1 of the main shaft 61 is transmitted to the side plate 54B of the roller support frame 54 via the first torque limiter 72 as described above, so that the roller support frame 54 is made pivot upward.

Further, when the tip portion of the stopper 70 of the roller support frame 54 abuts against the shaft 73, the first rotational torque T1, transmitted from the main shaft 61 to the side plate 54B of the roller support frame 54, becomes equal to or higher than the first threshold S1, and therefore the first torque limiter 72 disconnects the first rotational torque T1 transmitted to the side plate 54B, thereby stopping the movement of the roller support frame 54.

As shown in FIG. 3 and FIG. 4, a second torque limiter 78 is fixed to the support plate 64, and a shaft 79 is connected to the second torque limiter 78. To the shaft 79, a second one-way clutch 80 (see FIG. 7, FIG. 8A to FIG. 8C, and FIG. 9), and also a retention gear 81 is connected via the second one-way clutch 80. The retention gear 81 is meshed with the output gear 75 of the gear unit 74.

The second torque limiter 78 stops the rotation of the shaft 79, when a second rotational torque T2 of the shaft 79 is lower than a second threshold S2, thereby maintaining the rotational position of the shaft 79 and the retention gear 81. When the second rotational torque T2 of the shaft 79 is equal to or higher than the second threshold S2, the second torque limiter 78 disconnects the transmission of the second rotational torque T2 between the second torque limiter 78 and the shaft 79, so as not to limit the rotation of the shaft 79.

Now, when the motor 71 rotates counterclockwise CCW as shown in FIG. 8A, the output gear 75 of the gear unit 74 rotates counterclockwise, and the retention gear 81 rotates clockwise. In this case, the second one-way clutch 80 runs idle, and therefore the clockwise rotation of the retention gear 81 is not transmitted to the shaft 79. At the same time, the elevation gear 77 rotates clockwise, and the first one-way clutch 76 transmits the clockwise rotation of the elevation gear 77 to the main shaft 61, so that the main shaft 61 rotates clockwise, and the roller support frame 54 is made to pivot upward.

Then when the motor 71 stops as shown in FIG. 8B, a counterclockwise rotational torque, generated by the self-weight of the roller support frame 54, is sequentially transmitted through the main shaft 61, the elevation gear 77, the output gear 75 of the gear unit 74, and the retention gear 81 in this order, and the counterclockwise rotational torque is applied to the retention gear 81. Therefore, the second one-way clutch 80 transmits the counterclockwise rotational torque of the retention gear 81 to the shaft 79, and the second rotational torque T2 of the shaft 79 is transmitted to the second torque limiter 78.

In this case, the second rotational torque T2 transmitted to the second torque limiter 78 is based on the self-weight of the roller support frame 54, which is lower than the second threshold S2. Accordingly, the second torque limiter 78 stops the rotation of the shaft 79 and the retention gear 81. Therefore, the rotation of the elevation gear 77 is stopped, and the first one-way clutch 76 restricts the main shaft 61 from rotating counterclockwise. As result, the counterclockwise rotation arising from the self-weight of the roller support frame 54 is restricted, and the roller support frame 54 remains stopped at the elevated position.

When the motor 71 rotates clockwise CW as shown in FIG. 8C, the output gear 75 of the gear unit 74 rotates clockwise, and the retention gear 81 rotates counterclockwise. In this case, the second one-way clutch 80 transmits the counterclockwise rotation of the retention gear 81 to the shaft 79, and the second rotational torque T2 of the shaft 79 is transmitted to the second torque limiter 78.

The second rotational torque T2 transmitted to the second torque limiter 78 in the mentioned case is the sum of the torque based on the self-weight of the roller support frame 54, and the torque based on the rotative driving force of the motor 71, and is therefore equal to or higher than the second threshold S2. Therefore, the transmission of the second rotational torque T2 between the second torque limiter 78 and the shaft 79 is disconnected, so as not to limit the rotation of the shaft 79, and as result the shaft 79 and the retention gear 81 can rotate freely.

At the same time, the elevation gear 77 rotates counterclockwise, and the first one-way clutch 76 runs idle. Accordingly, the counterclockwise rotation of the elevation gear 77 is not transmitted to the main shaft 61, and the roller support frame 54 is made to pivot downward about the main shaft 61, owing to the self-weight.

To disconnect the transmission of the second rotational torque T2 between the second torque limiter 78 and the shaft 79, it suffices that the sum of the torque based on the self-weight of the roller support frame 54, and the torque based on the rotative driving force of the motor 71, becomes equal to or higher than the second threshold S2. Accordingly, the motor 71 is not required to output a large rotative driving force, and the provision of the second torque limiter 78 does not lead to an increase in size of the motor 71.

As described above, when the motor 71 rotates counterclockwise CCW, the output gear 75 of the gear unit 74 rotates counterclockwise, and the retention gear 81 rotates clockwise. Therefore, the second one-way clutch 80 runs idle, and the clockwise rotation of the retention gear 81 is not transmitted to the shaft 79. At the same time, the elevation gear 77 rotates clockwise, and the first one-way clutch 76 transmits the clockwise rotation of the elevation gear 77 to the main shaft 61, so that the roller support frame 54 is made to pivot upward.

When the motor 71 stops, a counterclockwise rotational torque is generated by the self-weight of the roller support frame 54, and the counterclockwise rotational torque is applied to the shaft 79 of the retention gear 81. Therefore, the second one-way clutch 80 transmits the counterclockwise rotational torque of the retention gear 81 to the shaft 79, and the second rotational torque T2 of the shaft 79 is transmitted to the second torque limiter 78. In this case, since the second rotational torque T2 of the shaft 79 does not reach the second threshold S2, the second torque limiter 78 stops the rotation of the shaft 79, and the retention gear 81 and the elevation gear 77 stop rotating. In addition, the first one-way clutch 76 restricts the main shaft 61 from rotating counterclockwise, and the elevation gear 77 and the roller support frame 54 are stopped.

When the motor 71 rotates clockwise CW, the output gear 75 of the gear unit 74 rotates clockwise, the retention gear 81 rotates counterclockwise, and the second one-way clutch 80 transmits the counterclockwise rotation of the retention gear 81 to the shaft 79. In this case, since the second rotational torque T2 of the shaft 79 becomes equal to or higher than the second threshold S2, the second torque limiter 78 does not limit the rotation of the shaft 79, and therefore the shaft 79 and the retention gear 81 can rotate freely. At the same time, the elevation gear 77 rotates counterclockwise, and the first one-way clutch 76 runs idle, so that the roller support frame 54 is made to pivot downward about the main shaft 61, owing to the self-weight.

Figure 9:
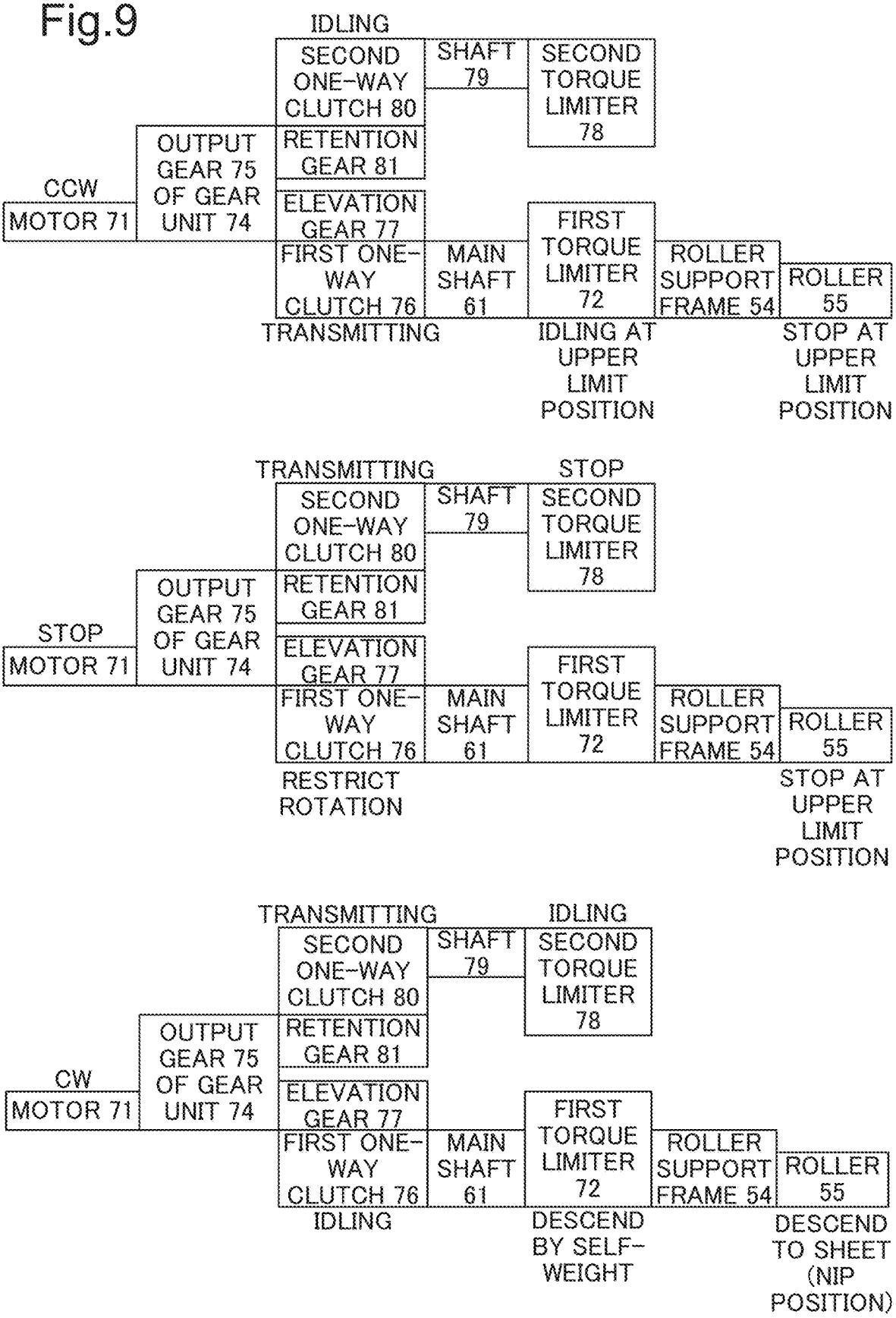
FIG. 9 is a schematic diagram systematically showing the working of the sheet alignment mechanism, with respect to each of the motion types of the motor.

FIG. 9 is a schematic diagram systematically showing the working of the output gear 75 of the gear unit 74, the elevation gear 77 (main shaft 61), the retention gear 81, the first one-way clutch 76, the second one-way clutch 80, the first torque limiter 72, and the second torque limiter 78, with respect to each of the CCW rotation, the stopped state, and the CW rotation of the motor 71.

As shown in FIG. 2 to FIG. 5, the sheet alignment mechanism 53 includes a side edge alignment device 82. The side edge alignment device 82 includes, in a unified form, a lower guide plate 83, an upper guide plate 84, and a connection member 85 supporting an end portion of the lower guide plate 83 and an end portion of the upper guide plate 84. The connection member 85 serves to keep unchanged the clearance between the lower guide plate 83 and the upper guide plate 84 in the up-down direction. The connection member 85 includes an alignment wall 85A erected vertically. One of the side edges of the sheet passes through between the lower guide plate 83 and the upper guide plate 84.

The upper guide plate 84 includes two openings 84A. When the roller support frames 54 are made to pivot downward, the pressing rollers 55 come close to, or make contact with the lower guide plate 83, through the respective openings 84A, and reach the nip position.

The side edge alignment device 82 is supported so as to reciprocatively move, in the width direction z of the sheet. To allow the reciprocating movement of the side edge alignment device 82, a motor 86, a shaft 73, a gear unit, gears 89, slide members 91, rack gears 92, plungers 93, and coil springs 94 are provided.

The shaft 73 extends so as to connect the support plate 63 and the support plate 62, and is rotatably supported thereby. The gear unit transmits the rotation of the motor 86 to the shaft 73. The gears 89 are connected to the respective ends of the shaft 73. The slide members 91 are supported so as to move in the sheet width direction z, on the lower side of the respective ends of the shaft 73. The rack gears 92 are fixed on the respective slide members 91, and meshed with the respective gears 89. The plungers 93 serve to connect the respective slide members 91 to the respective ends of the connection member 85 of the side edge alignment device 82. The coil springs 94 press the respective ends of the connection member 85 of the side edge alignment device 82, thereby removing the play between the slide member 91 and the side edge alignment device 82.

When the rotation of the output shaft of the motor 86 is transmitted to the shaft 73 via the gear unit, the shaft 73 rotates. When the output shaft of the motor 86 is switched, the rotation direction of the shaft 73 is also switched.

Referring to FIG. 5, when the shaft 73 is made to rotate counterclockwise by the motor 86, the gear 89 rotates counterclockwise, so that the rack gear 92 meshed with the gear 89 moves to the right, and the slide member 91, the plunger 93, and the side edge alignment device 82 move to the right. When the shaft 73 is made to rotate clockwise by the motor 86, the gear 89 rotates clockwise, so that the rack gear 92 meshed with the gear 89 moves to the left, and the slide member 91, the plunger 93, and the side edge alignment device 82 move to the left.

Figure 10:
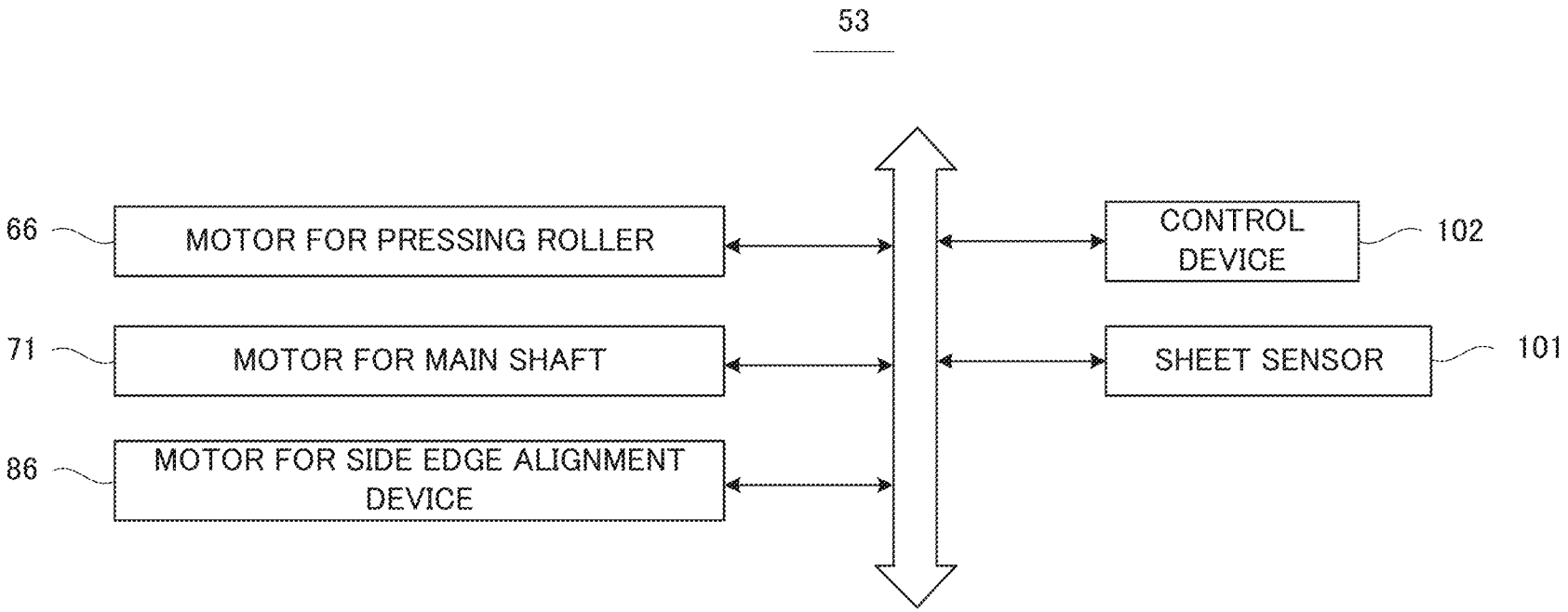
FIG. 10 is a block diagram showing a configuration of a control system of the sheet alignment mechanism.

FIG. 10 is a block diagram showing a configuration of a control system of the sheet alignment mechanism 53. As shown in FIG. 10, the sheet alignment mechanism 53 includes the motor 66, serving as the power source for making the pressing rollers 55 of the respective roller support frames 54 pivot, the motor 71 serving as the power source for rotating the main shaft 61, the motor 86 serving as the power source for moving the side edge alignment device 82, a sheet sensor 101, and a control device 102.

The sheet sensor 101 is located downstream of the pressing roller 55 in the sheet transport direction x, and detects the leading edge and the trailing edge of the sheet being transported. More specifically, the sheet sensor 101 detects the leading edge and the trailing edge of the sheet passing the pressing roller 55. The sheet sensor 101 includes, for example, a light emitting element that emits light to the sheet being transported, and a photodetector that receives the light reflected by the sheet. The sheet sensor 101 detects the presence of the sheet, when the photodetector receives the light emitted from the light emitting element, and detects that the sheet is not present, when the photodetector is unable to receive the light from the light emitting element.

The control device 102 is provided in the sheet feeding device 1. The control device 102 includes a processor, a random-access memory (RAM), and a read-only memory (ROM). The control device 102 serves to control the overall operation of the sheet feeding device 1, by executing a control program stored in a storage device. Alternatively, a control device provided in the image forming apparatus 2 to control the overall operation thereof may be adopted as the control device 102. In this case, the control device 102 acts as a part of the sheet feeding device 2.

The control device 102 decides the width of the sheet, on the basis of the sheet cassette 12 designated by an input to the operation device, or on the basis of the detection result from the sensor of the sheet cassette 12. The control device 102 controls the rotation speed and the rotation direction of the motor 86 for moving the side edge alignment device 82, and sets the alignment wall 85A of the connection member 85 in the side edge alignment device 82 in position, according to the width of the sheet decided as above.

In the sheet feeding device 1, the position of one of the side edges of the sheet, to be transported through the forward transport route 13 or the reversing transport route 14, is generally defined depending on the width of the sheet. Accordingly, by moving and setting in position the alignment wall 85A of the connection member 85 depending on the width of the sheet, the alignment wall 85A can be set at a position slightly spaced from the side edge of the sheet.

The control device 102 drives the motor 66 for making the pressing roller 55 of the roller support frame 54 pivot, thereby making the gear 59 and the pressing roller 55 of the roller support frame 54 rotate counterclockwise, as shown in FIG. 6A and FIG. 6B.

The control device 102 controls the operation of the motor 71 for making the main shaft 61 rotate, with the alignment wall 85A of the connection member 85 set in position and the gear 59 and the pressing roller 55 of the roller support frame 54 rotating counterclockwise as above, so as to make the roller support frame 54 pivot up or downward about the main shaft 61, or stop the movement of the roller support frame 54.

Figure 11:
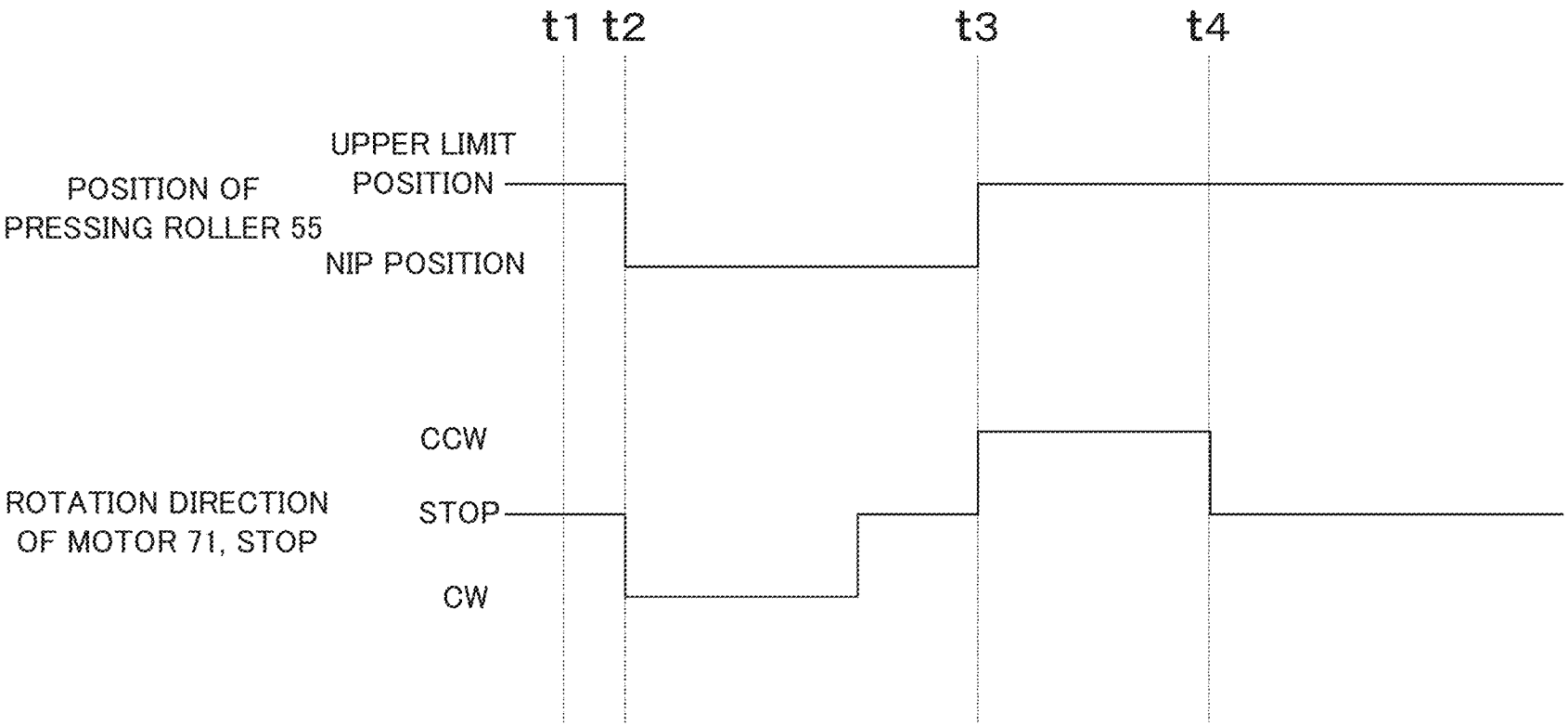
FIG. 11 is a timing chart showing a control process of the motor, performed to rotate a main shaft.

FIG. 11 is a timing chart showing a control process of the motor 71.

The control device 102 makes the motor 71 rotate counterclockwise CCW as shown in FIG. 8A, before a time point t1 that the sheet is delivered. Accordingly, the elevation gear 77 rotates clockwise, and the clockwise rotation of the elevation gear 77 is transmitted from the first one-way clutch 76 to the main shaft 61, so that the roller support frames 54 are made to pivot upward. Therefore, the pressing rollers 55 of the respective roller support frames 54 reach the upper-limit position, spaced from the lower guide plate 83.

When a prespecified time elapses after the motor 71 started to rotate counterclockwise CCW, the tip portion of the stopper 70 of the roller support frame 54 abuts against the shaft 73, and the roller support frame 54 reaches the upper-limit position. Accordingly, the control device 102 stops the rotation of the motor 71 as shown in FIG. 8B, at the time point that the prespecified time has elapsed. As result, the counterclockwise rotational torque, generated by the self-weight of the roller support frame 54 is sequentially transmitted to the main shaft 61, the elevation gear 77, the output gear 75 of the gear unit 74, and the retention gear 81 in this order, and the counterclockwise rotational torque of the retention gear 81 is transmitted from the second one-way clutch 80 to the shaft 79.

The second rotational torque T2, transmitted in this case from the shaft 79 to the second torque limiter 78, is lower than the second threshold S2. Accordingly, the second torque limiter 78 stops the rotation of the shaft 79, the retention gear 81 and the elevation gear 77 stop rotating, and the first one-way clutch 76 restricts the main shaft 61 from rotating counterclockwise. As result, the counterclockwise rotation, arising from the self-weight of the roller support frame 54, is restricted, and the roller support frame 54 remains stopped at the upper-limit position.

The control device 102 makes the motor 71 rotate clockwise CW as shown in FIG. 8C, at a time point t2 that the sheet sensor 101 has detected the leading edge of the sheet passing the pressing roller 55. Accordingly, the output gear 75 of the gear unit 74 rotates clockwise, and the retention gear 81 rotates counterclockwise. Therefore, the control device 102 causes the second one-way clutch 80 to transmit the counterclockwise rotational torque of the retention gear 81 to the shaft 79, thereby allowing the shaft 79 to freely rotate.

At the same time, the elevation gear 77 rotates counterclockwise, and the first one-way clutch 76 runs idle. Accordingly, the roller support frame 54 is made to pivot downward about the main shaft 61, owing to the self-weight, and the pressing roller 55 of the roller support frame 54 comes close to, or makes contact with the lower guide plate 83, and reach the nip position.

At the time point t2 that the sheet sensor 101 has detected the leading edge of the sheet passing the pressing roller 55 of the roller support frame 54, the side edge of the sheet is located between the lower guide plate 83 and the upper guide plate 84. When the pressing roller 55 descends to the nip position in such state, the pressing roller 55 is pressed against the side edge of the sheet on the lower guide plate 83, through the opening 84A of the upper guide plate 84.

At this point, the gear 59 and the pressing roller 55 of the roller support frame 54 are rotating counterclockwise, as shown in FIG. 6A and FIG. 6B. Therefore, the pressing roller 55 moves the side edge of the sheet on the lower guide plate 83, so as to make the side edge abut against the alignment wall 85A of the connection member 85. As result, the side edge of the sheet becomes parallel to the alignment wall 85A, thus to be set in position in the sheet width direction z.

Here, while the pressing roller 55 is pressed against the side edge of the sheet, so as to make the side edge of the sheet abut against the alignment wall 85A, the control device 102 may stop the rotation of the transport rollers 51 and 52 of the sheet alignment device 11, thereby releasing the sheet from the nipped state under the transport rollers 51 and 52, and allow the transport rollers 51 and 52 to again nip the sheet and resume the transport of the sheet, after the side edge of the sheet has abutted against the alignment wall 85A.

At a time point t3 that the sheet sensor 101 has detected the trailing edge of the sheet that has passed the pressing roller 55, the control device 102 makes the motor 71 rotate counterclockwise CCW, as shown in FIG. 8A. Accordingly, the elevation gear 77 rotates clockwise, and the clockwise rotation of the elevation gear 77 is transmitted from the first one-way clutch 76 to the main shaft 61, so that the roller support frame 54 is made to pivot upward. As result, the pressing roller 55 is separated from the lower guide plate 83.

At a time point t4, a prespecified time after the motor 71 started to rotate counterclockwise CCW, the tip portion of the stopper 70 of the roller support frame 54 abuts against the shaft 73, and the roller support frame 54 reaches the upper-limit position. Accordingly, the control device 102 stops the rotation of the motor 71, at the time point t4. Therefore, the counterclockwise rotational torque, generated by the self-weight of the roller support frame 54, is sequentially transmitted through the main shaft 61, the elevation gear 77, the output gear 75 of the gear unit 74, and the retention gear 81 in this order, and the counterclockwise rotational torque of the retention gear 81 is transmitted from the second one-way clutch 80 to the shaft 79. As result, the second torque limiter 78 stops the rotation of the shaft 79, and the roller support frame 54 stops at the upper-limit position.

Thereafter, the control device 102 repeats the control of the motor 71 from the time point t1 to the time point t4, so that the side edge of the sheet is abutted against the alignment wall 85A, each time the side edge of the sheet enters the region between the lower guide plate 83 and the upper guide plate 84.

In the case where a paper jam occurs in the sheet alignment mechanism 53, the control device 102 makes the motor 71 rotate counterclockwise CCW, as shown in FIG. 8A. Accordingly, the elevation gear 77 rotates clockwise, and the roller support frame 54 is made to pivot upward, so that the pressing roller 55 moves away from the lower guide plate 83. Then the control device 102 stops the motor 71, and detains the roller support frame 54 at the upper-limit position.

For example, the control device 102 measures the time after the sheet sensor 101 has detected the leading edge of the sheet passing the pressing roller 55 of the roller support frame 54, and until the sheet sensor 101 detects the trailing edge of the sheet. When the measured time reaches a prespecified time, the control device 102 decides that the paper jam has occurred, and brings the roller support frame 54 to the upper-limit position. Accordingly, the pressing roller 55 of the roller support frame 54 can be kept spaced from the lower guide plate 83, which facilitates the jammed paper to be removed.

Further, in the case where the control device 102 disconnects the power supply to the motor 71, in addition to stopping the rotation thereof, the electromagnetic force of the motor 71 is cancelled, so that the output shaft of the motor 71 can freely rotate. In this case also, since the rotation of the shaft 79 is stopped by the second torque limiter 78, the output gear 75 can be kept from rotating owing to the cancellation of the electromagnetic force of the motor 71, and the roller support frame 54 can be detained at the upper-limit position.

In the sheet transport device, it is desirable to supply the sheet to the image forming apparatus, with the side edge aligned so that the skew is corrected. For example, the sheet transport device may include, for the purpose of aligning the side edge of the sheet, a roller that rotates upon being contacted by the sheet, so as to move the sheet in the direction orthogonal to the sheet transport direction, thereby making the side edge of the sheet abut against the alignment member.

With the mentioned technique, in the case where the jam occurs while the sheet is being transported to the position where the alignment member and the roller are located, or the jam occurs in the proximity of the alignment member and the roller, a mechanism that moves the roller to and away from the sheet is required.

In the aforementioned existing transport route opening mechanism and the image forming apparatus, the pinching force of the transport rollers for transporting the sheet is reduced, or the transport roller and the free roller are moved away from each other, to facilitate the removal of the jammed sheet. However, in either of the existing transport route opening mechanism and the image forming apparatus, a technique to move the roller, which moves the sheet in the direction orthogonal to the sheet transport direction, to and away from the sheet, is not conceived.

According to the foregoing embodiment, in contrast, by the combination of the first one-way clutch 76, the first torque limiter 72, the second one-way clutch 80, the second torque limiter 78, the elevation gear 77, and the retention gear 81, the pressing roller 55 of the roller support frame 54 can be made to pivot up and downward, so as to move the pressing roller 55 to and away from the sheet. In addition, the pressing roller 55 serves to move the sheet in the direction orthogonal to the sheet transport direction, thereby aligning the side edge of the sheet.

The self-weight of the pressing roller 55 is utilized to nip the sheet, and therefore the nipping force can be constantly maintained at an appropriate level, and the action for aligning the side edge of the sheet can be stably performed.

The pressing roller 55 can be detained at the upper-limit position, and therefore the jammed sheet can be easily removed.

In addition, the second torque limiter 78 stops the rotation of the shaft 79, despite the electromagnetic force of the motor 71 having been cancelled to allow the output shaft of the motor 71 to rotate freely. Therefore, the output gear 75 can be kept from rotating owing to the cancellation of the electromagnetic force of the motor 71, and the roller support frame 54 can be detained at the upper-limit position.

Further, to transmit the rotational force of the motor 71, a worm wheel may be employed, so as to detain the roller support frame 54 at the upper-limit position, with the self-lock function of the worm wheel. However, such an arrangement may incur an increase in reduction ratio, and a decline in responsiveness. Alternatively, the roller support frame 54 may be stopped at the upper-limit position using a detent torque of a stepping motor. In this case, however, the size of the motor has to be increased.

In contrast, with the arrangement according to the foregoing embodiment, the pressing roller 55 of the roller support frame 54 can be made to pivot up and downward, to move the pressing roller 55 to and away from the sheet, free from such drawbacks as the increase in reduction ratio, decline in responsiveness, and increase in size of the motor acting as the drive source.

Further, the configurations and processings described in the embodiments with reference to FIG. 1 to FIG. 11 are merely exemplary, and in no way intended to limit the disclosure to those configurations.

While the present disclosure has been described in detail with reference to the embodiments thereof, it would be apparent to those skilled in the art that various changes and modifications may be made therein within the scope defined by the appended claims.

What is claimed is:

1. A sheet alignment device comprising:

a sheet transport route on which a sheet is transported;

an alignment member provided along a side edge of the sheet located on the sheet transport route;

a roller that rotates by being contacted by the sheet being transported along the sheet transport route, and makes the side edge of the sheet abut against the alignment member, by moving the sheet in a direction orthogonal to a sheet transport direction;

a roller support device supporting the roller, the roller support device including a shaft spaced from the roller, and configured to make the roller contact the sheet or move away therefrom, by being supported so as to reciprocatively pivot about the shaft in an up-down direction;

a motor that provides a rotative driving force;

a first one-way clutch that transmits a first rotative driving force for making the roller support device pivot upward with respect to the shaft of the roller support device, when the motor rotates in a predetermined first direction;

a rotation control device that limits rotation of the shaft, when the roller support device is made to pivot upward;

a first torque limiter that disconnects the first rotative driving force from the first one-way clutch, when the rotation control device limits the rotation of the shaft;

a second one-way clutch that rotates with a second rotative driving force, generated by a self-weight of the roller support device when the motor is stopped, and making the roller support device pivot downward; and a second torque limiter that stops the rotation of the shaft, by being subjected to a rotational torque of the second one-way clutch.

2. The sheet alignment device according to claim 1, wherein the second one-way clutch runs idle when the motor is rotating in the first direction, and when the motor rotates in a second direction opposite to the first direction, the second one-way clutch is made to rotate by the second rotative driving force, and disconnects transmission between the second one-way clutch and the second torque limiter, the first one-way clutch runs idle, and the roller support device is made to pivot downward about the shaft, by the self-weight.

3. The sheet alignment device according to claim 1, wherein, when the roller support device is made to pivot downward about the shaft, by the self-weight, the roller makes contact with the sheet being transported along the sheet transport route, and when the roller rotates in such state, the sheet moves in the orthogonal direction, and the side edge of the sheet abuts against the alignment member.

4. The sheet alignment device according to claim 1, further comprising:

an output gear to be made to rotate by a rotative driving force of the motor; and an elevation gear and a retention gear, meshed with the output gear, wherein first one-way clutch is provided between the shaft and the elevation gear, the first torque limiter is provided between the roller support device and the shaft, the second one-way clutch receives the second rotative driving force from the retention gear, and the second torque limiter is connected to a shaft of the second one-way clutch.

5. The sheet alignment device according to claim 1, wherein the second torque limiter stops rotation of the shaft, when the rotational torque is lower than a predetermined threshold, and disconnects transmission of the rotational torque from the second one-way clutch, when the rotational torque is equal to or higher than the threshold.

* * * * *